US009790748B2

(12) United States Patent
Hradecky

(10) Patent No.: US 9,790,748 B2
(45) Date of Patent: Oct. 17, 2017

(54) WIRELINE ROLLER STANDOFF

(71) Applicant: Impact Selector, Inc., Heath, TX (US)

(72) Inventor: Jason Allen Hradecky, The Woodlands, TX (US)

(73) Assignee: IMPACT SELECTOR INTERNATIONAL, LLC, Houma, LA (US)

( * ) Notice: Subject to any disclaimer, the term of this patent is extended or adjusted under 35 U.S.C. 154(b) by 493 days.

(21) Appl. No.: 14/340,257

(22) Filed: Jul. 24, 2014

(65) Prior Publication Data

US 2015/0027729 A1 Jan. 29, 2015

Related U.S. Application Data

(60) Provisional application No. 61/857,887, filed on Jul. 24, 2013.

(51) Int. Cl.
*E21B 17/10* (2006.01)
*E21B 23/14* (2006.01)

(52) U.S. Cl.
CPC ..... *E21B 17/1057* (2013.01); *E21B 23/14* (2013.01)

(58) Field of Classification Search
CPC ..... E21B 17/1057; E21B 17/10; E21B 23/14; E21B 17/1035
See application file for complete search history.

(56) References Cited

U.S. PATENT DOCUMENTS

| | | | | |
|---|---|---|---|---|
| 1,794,278 | A | 2/1931 | Carney | |
| 1,827,835 | A | 10/1931 | Willliam | |
| 3,125,382 | A | 3/1964 | Herndon | |
| 4,372,622 | A | 2/1983 | Cheek | |
| 4,871,020 | A | 10/1989 | Rivas et al. | |
| 4,919,205 | A | 4/1990 | Dollison | |
| 4,924,549 | A | 5/1990 | Morel et al. | |
| 4,972,911 | A | 11/1990 | Rajakallio | |
| 5,040,619 | A * | 8/1991 | Jordan | E21B 17/1057 166/241.1 |
| 5,358,042 | A | 10/1994 | Stoltz | |
| 5,692,532 | A | 12/1997 | Gabrovsek | |
| 5,692,563 | A | 12/1997 | Krueger et al. | |
| 5,941,312 | A | 8/1999 | Vermeeren | |
| 6,209,667 | B1 | 4/2001 | Murray et al. | |
| 6,250,394 | B1 | 6/2001 | Mashburn | |
| 6,382,333 | B1 | 5/2002 | Murray | |
| 6,453,999 | B1 | 9/2002 | Reinholdt | |
| 6,585,043 | B1 | 7/2003 | Murray | |

(Continued)

FOREIGN PATENT DOCUMENTS

WO 2015013538 A2 1/2015

*Primary Examiner* — Daniel P Stephenson
(74) *Attorney, Agent, or Firm* — Boisbrun Hofman, PLLC

(57) ABSTRACT

Apparatus comprising a gripper operable to grip a cable extending between the Earth's surface and a downhole tool, wherein the downhole tool is suspended in a wellbore that extends from the Earth's surface to one or more subterranean formations. A body is assembled to the gripper. A plurality of rolling elements are each rotatably coupled to the body and operable to rotate relative to the body in response to contact with a sidewall of the wellbore as the body is translated along the wellbore. The body and the plurality of rolling elements collectively rotate relative to the gripper and, thus, the cable.

20 Claims, 5 Drawing Sheets

(56) References Cited

U.S. PATENT DOCUMENTS

| | | | | |
|---|---|---|---|---|
| 6,684,965 | B1 | 2/2004 | Bakke | |
| 6,688,409 | B1 | 2/2004 | Murray | |
| 6,779,598 | B2 | 8/2004 | Hall | |
| 6,830,103 | B2 | 12/2004 | Bowles | |
| 6,845,816 | B2 | 1/2005 | Kirk et al. | |
| 7,048,064 | B1 | 5/2006 | Smith | |
| 7,255,165 | B2 | 8/2007 | Abdo et al. | |
| 7,395,881 | B2 | 7/2008 | McKay et al. | |
| 7,403,000 | B2 | 7/2008 | Barolak et al. | |
| 7,434,627 | B2 | 10/2008 | Turley et al. | |
| 8,733,455 | B2 | 5/2014 | Shaikh et al. | |
| 8,919,436 | B2 | 12/2014 | Wheater et al. | |
| 2008/0164018 | A1* | 7/2008 | Hall | E21B 17/1057 166/241.1 |
| 2009/0003974 | A1* | 1/2009 | McNay | E21B 17/1057 414/22.51 |
| 2010/0276138 | A1 | 11/2010 | Wittman et al. | |
| 2012/0018145 | A1* | 1/2012 | Wheater | E21B 17/10 166/241.5 |
| 2012/0031609 | A1 | 2/2012 | Wheater et al. | |
| 2012/0145380 | A1 | 6/2012 | Draper et al. | |
| 2015/0027729 | A1* | 1/2015 | Hradecky | E21B 17/1057 166/378 |

* cited by examiner

WIRELINE ROLLER STANDOFF

CROSS-REFERENCE TO RELATED APPLICATIONS

This application claims priority to and the benefit of U.S. Provisional Application No. 61/857,887, entitled "Wireline Roller Standoff," filed Jul. 24, 2013, the entire disclosure of which is hereby incorporated herein by reference.

BACKGROUND OF THE DISCLOSURE

Drilling and other downhole operations increasingly involve working in deeper, more complex, and harsher environments. Consequences associated with these types of operations may include equipment becoming stuck, lost, or damaged, as well as increased work times and costs.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
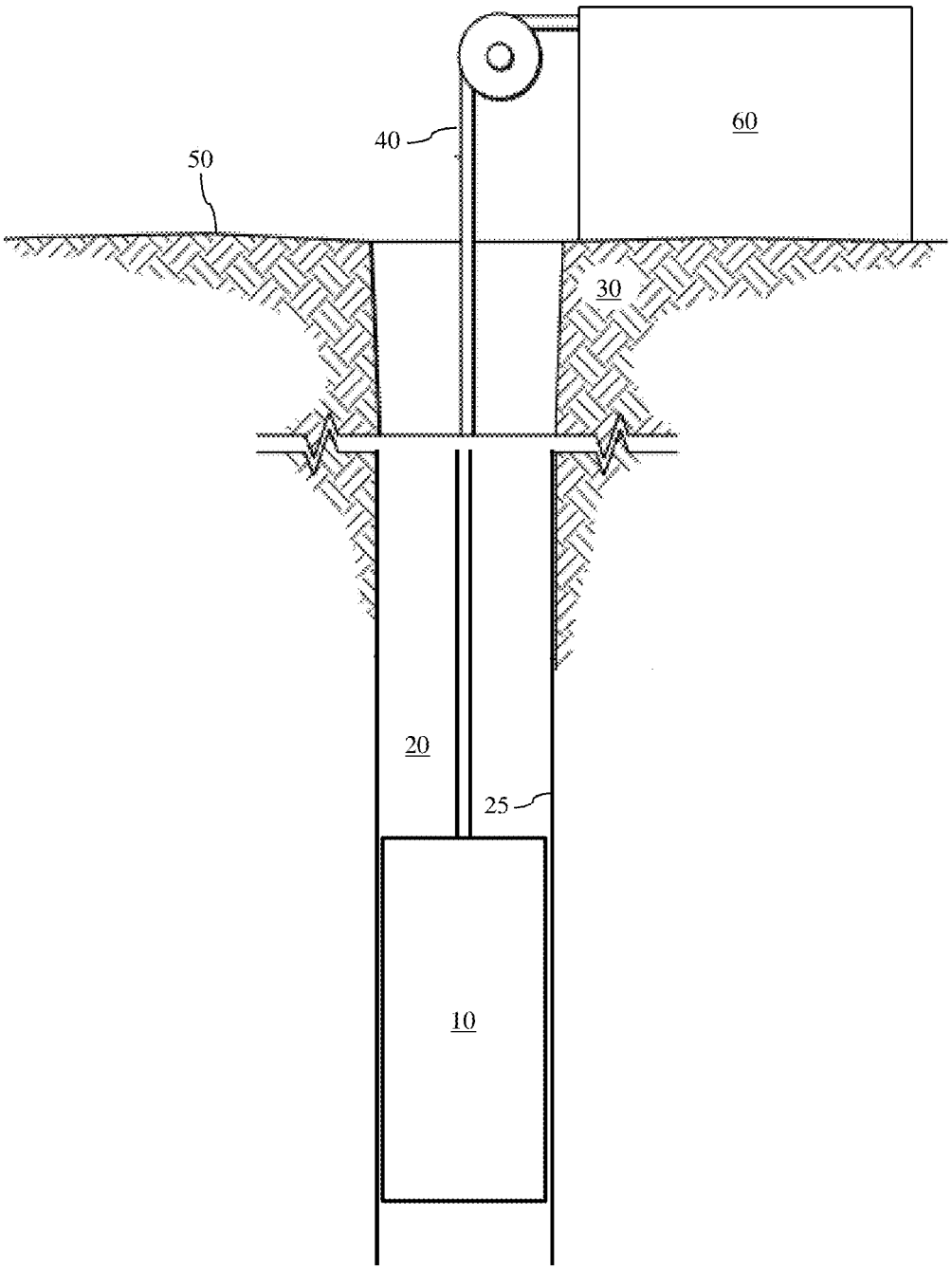
FIG. 1 is a schematic view of prior art apparatus.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 depicts a downhole tool 10 suspended in a wellbore 20 that extends through one or more subterranean formations 30. The downhole tool 10 is suspended via a wireline, slickline, E-line, and/or other cable 40 spooled at the surface 50 and coupled to surface equipment 60. The wellbore 20 is substantially vertical, or perpendicular to the surface 50. The cable 40 is reeled in and out such that gravity and the unreeled length of the cable 40 primarily dictate the depth of the downhole tool 10. Because the wellbore 20 is substantially vertical, the sidewalls 25 of the wellbore usually won't impede the intended conveyance of the downhole tool 10 within the wellbore 20. However, this may not be true for non-vertical walls.

Figure 2:
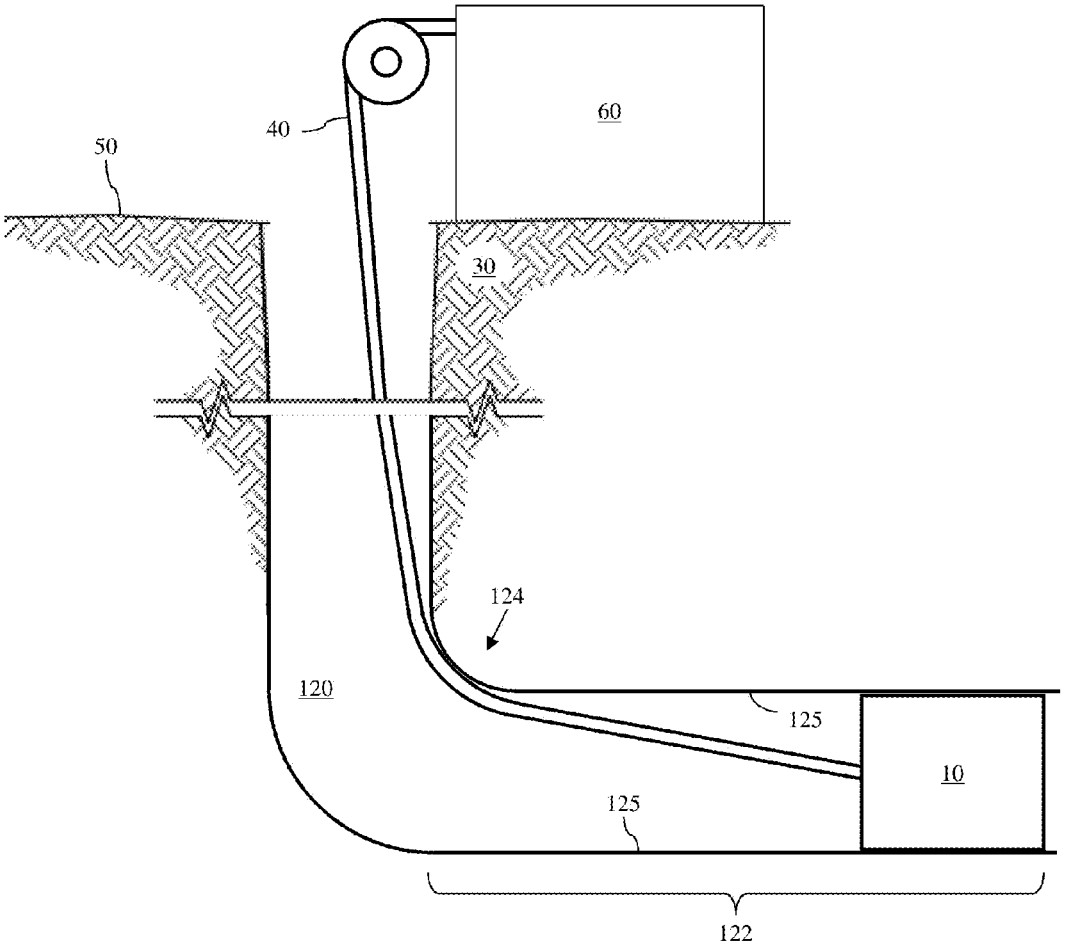
FIG. 2 is a schematic view of prior art apparatus.

FIG. 2 depicts the downhole tool 10 suspended in a horizontal or otherwise non-vertical wellbore 120. Wells being drilled today are increasingly likely to have at least one section that is not substantially vertical, such as the section 122 of the wellbore 120 depicted in FIG. 2. As a result, the sidewall(s) 125 of the wellbore 120, particularly at bends, corners, trajectory changes, and/or other transitions 124 of the wellbore 120, may impede passage of the cable 40 and, thus, the intended conveyance of the downhole tool 10 within the wellbore 120. For example, the cable 40 may become stuck in the sidewall 125 of the wellbore 120, such as in ruts generated by extension and retraction of the cable 40 and the subsequent abrasion against the sidewall 125 of the wellbore 120, or when the cable 40 is left against the sidewall 125 for a period of time sufficient to allow accumulation of particulate and debris adjacent the cable 40.

Figure 3:
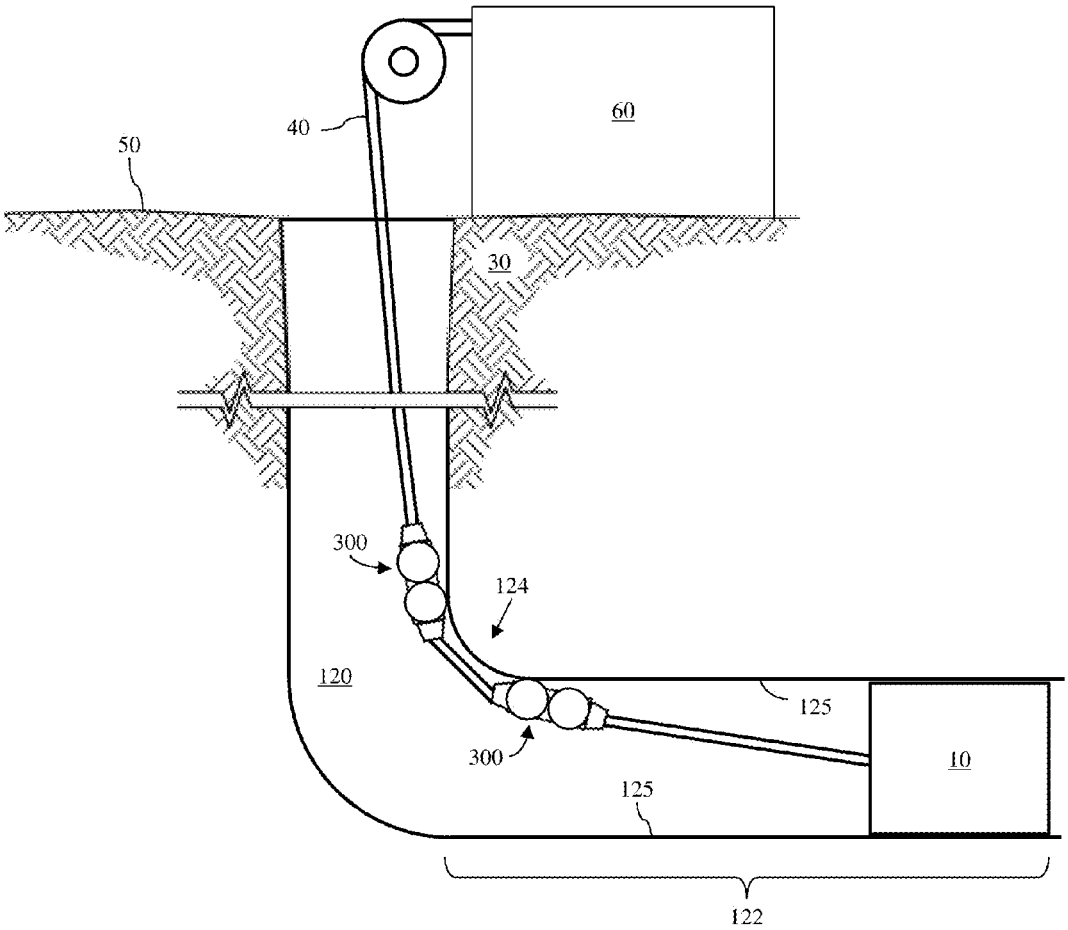
FIG. 3 is a schematic view of at least a portion of apparatus according to one or more aspects of the present disclosure.
Figure 4:
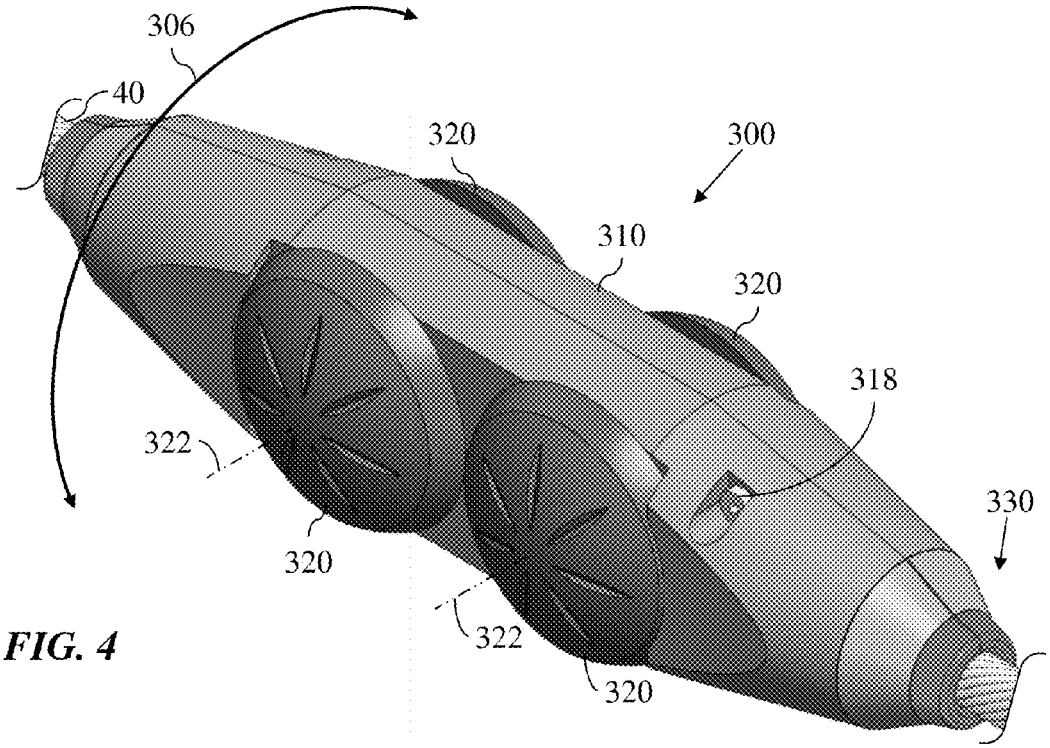
FIG. 4 is a perspective view of a portion of the apparatus shown in FIG. 3.
Figure 5:
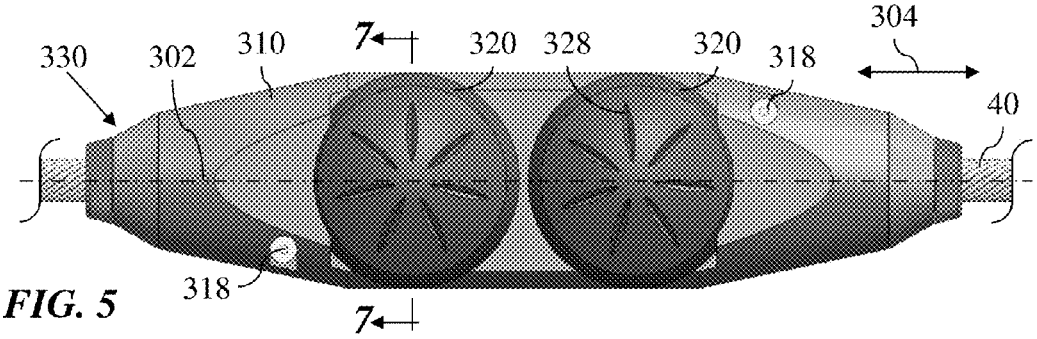
FIG. 5 is a side view the apparatus shown in FIG. 4.
Figure 6:
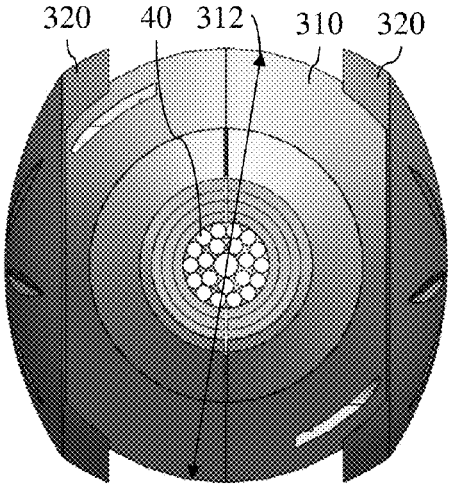
FIG. 6 is an end view of the apparatus shown in FIGS. 4 and 5.

Accordingly, the present disclosure introduces a standoff 300 that may aid in keeping the cable 40 away from the sidewall 125 of the wellbore 120, among other potential aspects. For example, FIG. 3 depicts the same apparatus as depicted in FIG. 2, but with the addition of two instances of the standoff 300 according to one or more aspects of the present disclosure. FIG. 4 is a perspective view of the standoff 300, FIG. 5 is a side view of the standoff 300, and FIG. 6 is an end view of the standoff 300. The following discussion collectively refers to FIGS. 3-6.

In response to conveyance of the downhole tool 10 and the cable 40 within the wellbore 120, each standoff 300 may roll along the sidewall 125 of the wellbore 120, such as in a direction substantially parallel to the longitudinal axis 302 of the standoff 300 and/or cable 40, as indicated by arrow 304 in FIG. 5. For example, each standoff 300 includes a body 310 and a plurality of rolling elements 320 each operable to rotate relative to the body 310, such as around a corresponding rotational axis 322 that may be substantially perpendicular to the longitudinal axis 302, and/or otherwise to aid translation of the standoff 300 relative to the wellbore 120 while one or more of the rolling elements 320 contact the sidewall 125 of the wellbore 120.

Conveyance of the downhole tool 10 and the cable 40 within the wellbore 120 may also cause each standoff 300 to swivel or rotate about the longitudinal axis 302 of the standoff 300 and/or the cable 40, as indicated by arrow 306 in FIG. 4. For example, each standoff 300 includes a gripper 330 coupled to the cable 40, and the body 310 is rotatably coupled to the gripper 330 in a manner permitting rotation of the body 310 relative to the gripper 330, such as around the longitudinal axis 302.

As most clearly shown in FIG. 5, each rolling element 320 may have an exterior surface with ridges, slots, recesses, protrusions, and/or other features 328 which may aid in engagement with the sidewall 125 of the wellbore 120. Such features 328 may encourage rolling engagement between the standoff 300 and the sidewall 125 of the wellbore 120, instead of sliding engagement. Thus, the features 328 may also encourage rotation of the body 310 relative to the cable 40, in addition to rotation of one or more rolling elements 320 relative to the body 310.

In the example implementation illustrated in FIGS. 3-5, each standoff 300 includes four instances of the rolling elements 320. However, the rolling elements 320 may be included in other numbers within the scope of the present disclosure. At a minimum, however, each standoff 300 may have at least one pair of rolling elements 320, with at least one rolling element 320 disposed on each opposing side of the body 310.

The body 310 may have an overall shape that is substantially oblong, perhaps having a central section (relative to its length along longitudinal axis 302) that is thicker or larger diameter, and tapering toward the opposing ends. Such shape may encourage sliding of the end portions of the body 310 along the sidewall 125 of the wellbore 120, and/or otherwise discourage the standoff 300 from gouging into the sidewall 125 of the wellbore 120.

The example implementation illustrated in FIG. 3 depicts two instances of the standoff 300. However, the number and spacing of the standoffs 300 may vary based on, for example, the trajectory of the wellbore 120, the condition of the sides 125 of the wellbore 120, the size and stiffness of the cable 40, the size and number of rolling elements 330, and/or other factors.

FIGS. 4-6 depict the cable 40 as being a multi-conductor, perhaps braided wireline cable. However, other cables are also within the scope of the present disclosure, including mono-cable, shielded cable, armored cable, slickline cable, E-line cable, and others.

Figure 7:
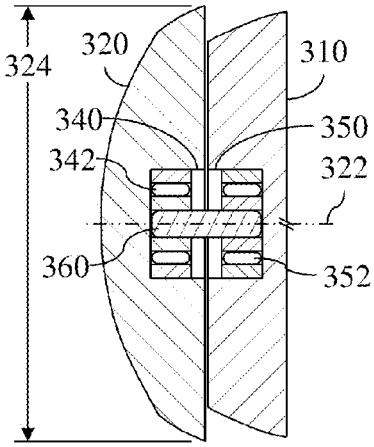
FIG. 7 is a sectional view of the apparatus shown in FIGS. 4-6.

FIG. 7 is a sectional view taken along the indicated lines in FIG. 5. For clarity, only a portion of the body 310 is depicted. Referring to FIGS. 6 and 7, collectively, each rolling element 320 may have a maximum outer diameter 324 that is substantially equal to or greater than an effective maximum outer diameter 312 of the body 310.

Each rolling element 320 may be individually coupled to the body 310 in a manner permitting rotation independent of the other rolling elements 320. For example, each rolling element 320 may comprise a recess 340 in receipt of a bearing, bushing, and/or other element 342, and the body 310 may comprise corresponding recesses 350 each in receipt of a bearing, bushing, and/or other element 352, wherein a spindle, axle, rod, and/or other connecting member 360 may extend between corresponding ones of the elements 342 and 352, thus rotatably coupling the rolling element 320 with the body 310. However, other arrangements for rotatably coupling the rolling elements 320 with the body 310 are also within the scope of the present disclosure. For example, the connecting member 360 may be non-rotatably coupled to either the rolling element 320 or the body 310, such that only one of the elements 342 and 352 may be included. The element 342 may be secured within the recess 340, and/or the element 352 may be secured within the recess 350, by press-fit, interference fit, adhesive, threaded engagement, one or more threaded fasteners, and/or other means.

Figure 8:
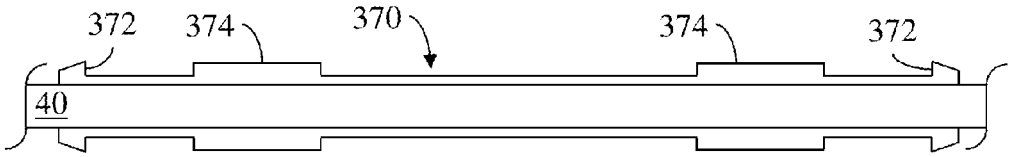
FIG. 8 is a side view of the apparatus shown in FIGS. 4-7 is an initial or intermediate stage of assembly according to one or more aspects of the present disclosure.
Figure 9:
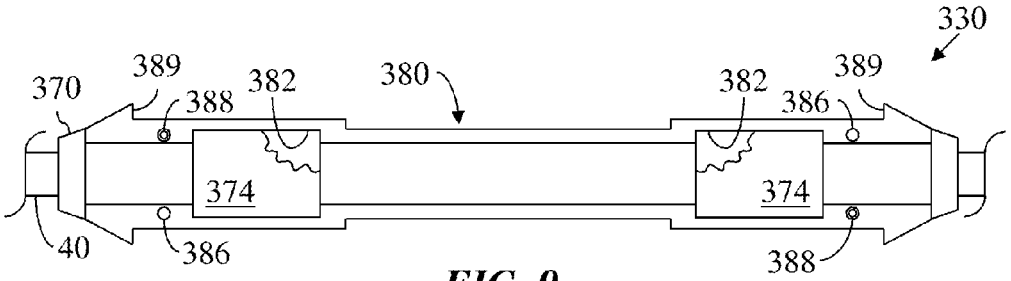
FIG. 9 is a side view of the apparatus shown in FIG. 8 in a subsequent stage of assembly.

FIG. 8 is a side view of an initial or intermediate stage of assembling the standoff 300 to the cable 40, and FIG. 9 is a side view in a subsequent stage of assembly. The gripper 330 may comprise a gripping insert 370 and a chassis 380. The gripping insert 370 is operable to contact a substantially cylindrical surface area of the cable 40, and the chassis 380 surrounds the gripping insert 370, thus securing the assembled gripper 330 to the cable 40. Opposing halves of the gripping insert 370 may first be disposed along the cable 40. FIG. 8 shows one of such halves of the gripping insert 370. Opposing halves of the chassis 380 may then be clamped together around the two assembled halves of the gripping insert 370, as depicted in FIG. 9. For clarity, FIG. 9 shows only one of the halves of the chassis 380, but does depict the assembled halves of the gripping insert 370.

Figure 10:
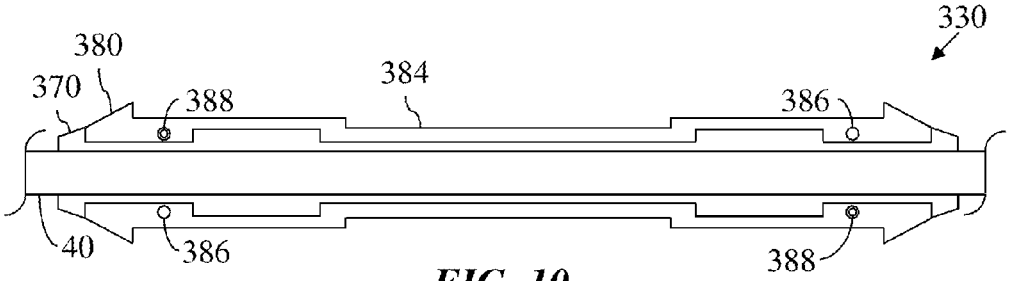
FIG. 10 is a side view of the apparatus shown in FIGS. 4-7 is an initial or intermediate stage of assembly according to one or more aspects of the present disclosure.

Alternatively, each half of the gripping insert 370 may be assembled into a corresponding one of the halves of the chassis 380, and then each such subassembly may be positioned against the cable 40 and coupled together. For clarity, FIG. 10 shows only one of such subassemblies (comprising one of the halves of the gripping insert 370 received within the corresponding one of the halves of the chassis 380) disposed adjacent the cable 40.

In either such assembly method, among others within the scope of the present disclosure, the gripping insert 370 may comprise opposing shoulders 372 between which the chassis 380 may be axially retained. Alternatively, or additionally, the chassis 380 may comprise one or more internal recesses 382, and the gripping insert 370 may comprise one or more cylindrical upsets 374 received within corresponding ones of the internal recesses 382 of the chassis 380.

The opposing halves of the chassis 380 may comprise threaded holes and/or other openings 386 for receiving the threaded end of a threaded fastener and/or other fastening member 388 to couple the halves to each other. The opposing halves of the chassis 380 may also comprise alignment pins and corresponding openings, and/or similar features for aligning the opposing halves for assembly.

The gripping insert 370 may have a material hardness that is substantially less than a material hardness of the cable 40. Thus, the gripping insert 370 may be materially deformed by the contact with the cable 40 in response to the clamping force applied to the gripping insert 370 by the chassis 380. Such clamping force may be proportional or otherwise related to the force applied to/by threaded fasteners and/or other means utilized to couple the opposing halves of the chassis 380 to each other around the gripping insert 370. The gripping insert 370 may also have a material hardness that is substantially less than the material hardness of the chassis 380, such as in implementations in which the gripping insert 370 is a disposable or consumable component that is replaced after each use.

Figure 11:
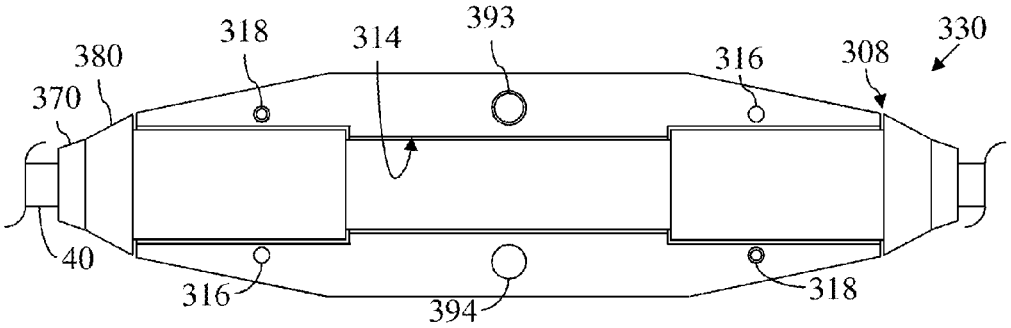
FIG. 11 is a side view of the apparatus shown in FIGS. 9 and/or 10 in a subsequent stage of assembly.

As shown in FIG. 11, the body 310 may comprise opposing body halves, only one of which is shown in FIG. 11 for the sake of clarity. The opposing halves of the body 310 may comprise threaded holes and/or other openings 316 for receiving the threaded end of a threaded fastener and/or other fastening member 318 to couple the halves to each other. The opposing halves of the body 310 may also comprise one or more alignment pins 393 and corresponding openings 394, and/or similar features for aligning the opposing halves for assembly.

Whether the gripper 330 is assembled to the cable 40 by assembling the gripping insert 370 to the cable 40 first or to the chassis 380 first, the body 310 is subsequently assembled to the gripper 330 by the fastening members 318 and/or otherwise. However, such assembly nonetheless permits the body 310 to rotate relative to the chassis 380, such as may be permitted by a gap or space 308 between the internal profile 314 of the body 310 and the external profile 384 of the chassis 380.

After such assembly, the body 310 is axially retained between opposing shoulders 389 of the chassis 380. Alternatively, or additionally, the body 310 may comprise one or more internal recesses sized to receive corresponding cylindrical upsets and/or other protrusions and/or other portions of the external profile 384 of the chassis 380.

In view of the entirety of the present disclosure, including the figures and the claims, a person having ordinary skill in the art will readily recognize that the present disclosure introduces an apparatus comprising: a gripper operable to grip a cable extending between the Earth's surface and a downhole tool, wherein the downhole tool is suspended in a wellbore that extends from the Earth's surface to one or more subterranean formations; a body assembled to the gripper; and a plurality of rolling elements each rotatably coupled to the body and operable to rotate relative to the body in response to contact with a sidewall of the wellbore as the body is translated along the wellbore; wherein the body and the plurality of rolling elements collectively rotate relative to the gripper and, thus, the cable.

The plurality of rolling elements may comprise a pair of rolling elements disposed on opposing sides of the body.

The gripper may comprise: a gripping insert operable to contact a substantially cylindrical surface area of the cable; and a chassis surrounding the gripping insert. The gripping insert may comprise opposing shoulders between which the chassis may be axially retained. The chassis may comprise an internal recess, and the gripping insert may comprise a cylindrical upset received within the internal recess of the chassis. The body may rotate relative to the chassis. The chassis may comprise opposing chassis halves, and the gripping insert may comprise opposing insert halves each received within a corresponding one of the chassis halves. The gripping insert may have a first material hardness, the cable may have a second material hardness, and the first material hardness may be substantially less than the second material hardness. The chassis may have a third material hardness, and the first material hardness may be substantially less than the third material hardness. The gripping insert may be materially deformed by the cable in response to a clamping force applied to the gripping insert by the chassis.

The body may comprise opposing body halves.

Each of the plurality of rolling elements may be rotatably coupled to the body by a spindle and at least one bearing.

The present disclosure also introduces a method comprising: conveying a downhole tool via a cable to a first depth within a wellbore; then coupling a standoff to the cable, wherein the standoff comprises a gripper, a body, and a plurality of rolling elements each rotatably coupled to the body, and wherein coupling the standoff to the cable comprises: coupling the gripper to the cable; and then assembling the body to the gripper; and then rotating at least one of the plurality of rolling elements relative to the body, and rotating the body relative to the gripper and the cable, by further conveying the downhole tool via the cable to a second depth within the wellbore.

The standoff may be a first one of a plurality of standoffs each comprising an instance of the gripper, the body, and the plurality of rolling elements, and the method may further comprise, after conveying the downhole tool to the second depth: coupling a second one of the plurality of standoffs to the cable; and then rotating at least one of the plurality of rolling elements of at least one of the plurality of standoffs relative to the body of the corresponding one of the plurality of standoffs, and rotating the body of at least one of the plurality of standoffs relative to the cable and the gripper of the corresponding one of the plurality of standoffs, by further conveying the downhole tool via the cable to a third depth within the wellbore.

The gripper may comprise a gripping insert and a chassis, and coupling the gripper to the cable may comprise: disposing the gripping insert around the cable; and clamping the chassis around the gripping insert.

The gripper may comprise a gripping insert and a chassis, the gripping insert may comprise opposing insert halves, the chassis may comprise opposing chassis halves, and coupling the gripper to the cable may comprise: assembling a first one of the insert halves within a first one of the chassis halves; assembling a second one of the insert halves within a second one of the chassis halves; and securing the first and second insert halves around the cable by coupling the first and second chassis halves together. Coupling the first and second chassis halves together may apply sufficient clamping force to the first and second insert halves around the cable so as to materially deform interior surfaces of the first and second insert halves that contact the cable.

The body may comprise opposing body halves, and assembling the body to the gripper may comprise coupling the opposing body halves together around the gripper.

The present disclosure also introduces a kit comprising: a gripper operable for assembly to a cable extending between the Earth's surface and a downhole tool, wherein the downhole tool is suspended in a wellbore that extends from the Earth's surface to one or more subterranean formations; and a body operable for assembly to the gripper after the gripper is assembled to the cable, wherein the body comprises a plurality of rolling elements each rotatably coupled to the body and operable to rotate relative to the body in response to contact with a sidewall of the wellbore as the body is translated along the wellbore; wherein, after the body is assembled to the gripper, the body and the plurality of rolling elements collectively rotate relative to the gripper and, thus, the cable. The gripper may comprise: a gripping insert operable for assembly to the cable to thereby contact a substantially cylindrical surface area of the cable; and a chassis operable for assembly to the gripping insert before or after the gripping insert is assembled to the cable.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A standoff for use with a cable suspending a downhole tool in a wellbore, the standoff comprising:

a gripping insert operable to contact and grip a substantially cylindrical surface area of the cable;

a chassis surrounding a cross-sectional circumference of the gripping insert;

a body surrounding and rotatable around a cross-sectional circumference of the chassis; and a plurality of rolling elements each rotatably coupled to the body and operable to rotate relative to the body in response to contact with a sidewall of the wellbore as the cable and the attached standoff is translated along the wellbore;

wherein the body and the plurality of rolling elements collectively rotate relative to the chassis and the gripping insert and, thus, the cable.

2. The standoff of claim 1 wherein the plurality of rolling elements comprises a pair of rolling elements disposed on opposing sides of the body.

3. The standoff of claim 1 wherein the plurality of rolling elements comprise:

a first rolling element disposed on a first side of the body;

a second rolling element disposed on the first side of the body and spaced apart from the first rolling element in a direction parallel to longitudinal axes of the gripping insert, the chassis, and the body;

a third rolling element disposed on a second side of the body that is opposite the first side of the body; and a fourth rolling element disposed on the second side of the body and spaced apart from the third rolling element in the direction.

4. The standoff of claim 3 wherein:

the first, second, third, and fourth rolling elements have respective first, second, third, and fourth rotational axes;

the first and third rotational axes are substantially coincident; and the second and fourth rotational axes are substantially coincident.

5. The standoff of claim 1 wherein the plurality of rolling elements consist of:

a first rolling element disposed on a first side of the body;

a second rolling element disposed on the first side of the body and spaced apart from the first rolling element in a direction parallel to longitudinal axes of the gripping insert, the chassis, and the body;

a third rolling element disposed on a second side of the body that is opposite the first side of the body; and a fourth rolling element disposed on the second side of the body and spaced apart from the third rolling element in the direction.

6. The standoff of claim 5 wherein:

the first, second, third, and fourth rolling elements have respective first, second, third, and fourth rotational axes;

the first and third rotational axes are substantially coincident; and the second and fourth rotational axes are substantially coincident.

7. The standoff of claim 1 wherein the gripping insert comprises opposing shoulders between which the chassis is axially retained.

8. The standoff of claim 1 wherein:

the chassis comprises an internal recess; and the gripping insert comprises a cylindrical upset received within the internal recess of the chassis.

9. The standoff of claim 1 wherein:

the chassis comprises opposing chassis halves; and the gripping insert comprises opposing insert halves each received within a corresponding one of the chassis halves.

10. The standoff of claim 1 wherein:

the gripping insert has first material hardness;

the cable has a second material hardness; and the first material hardness is substantially less than the second material hardness.

11. The standoff of claim 10 wherein:

the chassis has a third material hardness; and the first material hardness is substantially less than the third material hardness.

12. The standoff of claim 10 wherein the gripping insert is materially deformed by the cable in response to a clamping force applied to the gripping insert by the chassis.

13. The standoff of claim 1 wherein the body comprises opposing body halves.

14. The standoff of claim 1 wherein each of the plurality of rolling elements is rotatably coupled to the body by a spindle and at least one bearing.

15. The standoff of claim 1 wherein:

the plurality of rolling elements comprise:

a first rolling element disposed on a first side of the body;

a second rolling element disposed on the first side of the body and spaced apart from the first rolling element in a direction parallel to longitudinal axes of the gripping insert, the chassis, and the body;

a third rolling element disposed on a second side of the body that is opposite the first side of the body; and a fourth rolling element disposed on the second side of the body and spaced apart from the third rolling element in the direction;

the first, second, third, and fourth rolling elements have respective first, second, third, and fourth rotational axes, the first and third rotational axes are substantially coincident; and the second and fourth rotational axes are substantially coincident;

the gripping insert comprises opposing shoulders between which the chassis is axially retained;

the chassis comprises an internal recess, and the gripping insert comprises a cylindrical upset received within the internal recess of the chassis;

the chassis comprises opposing chassis halves, and the gripping insert comprises opposing insert halves each received within a corresponding one of the chassis halves;

the gripping insert has a material hardness that is substantially less than material hardnesses of the cable and the chassis;

the gripping insert is materially deformed by the cable in response to a clamping force applied to the gripping insert by the chassis;

the body comprises opposing body halves; and each of the plurality of rolling elements is rotatably coupled to the body by a spindle and at least one bearing.

16. A method, comprising:

conveying a downhole tool to a depth within a wellbore via a cable;

then, while the downhole tool is at the depth within the wellbore:

disposing a gripping insert around the cable such that the gripping insert surrounds a cross-sectional circumference of the cable; and then coupling a chassis and a body to the gripping insert such that the chassis surrounds a cross-sectional circumference of the gripping insert, and such that the body surrounds a cross-sectional circumference of the chassis, wherein each of a plurality of rolling elements is independently and rotatably coupled to the body; and then, by further conveying the downhole tool within the wellbore via the cable:

rotating at least one of the plurality of rolling elements relative to the body; and collectively rotating the body and the plurality of rolling elements relative to the gripping insert and the cable.

17. The method of claim 16 wherein the gripping insert comprises opposing gripping insert halves, wherein the chassis comprises opposing chassis halves, and wherein disposing the gripping insert around the cable and coupling the chassis and the body to the gripping insert collectively comprise:

assembling a first one of the insert halves within a first one of the chassis halves;

assembling a second one of the insert halves within a second one of the chassis halves; and securing the first and second insert halves around the cable by coupling the first and second chassis halves together.

18. The method of claim 17 wherein the body comprises opposing body halves, and wherein disposing the gripping insert around the cable and coupling the chassis and the body to the gripping insert collectively comprise, after coupling the first and second chassis halves together, coupling the opposing body halves together around the chassis.

19. A kit, comprising:

a gripper operable for assembly to a cable extending between the Earth's surface and a downhole tool, wherein the downhole tool is suspended in a wellbore that extends from the Earth's surface to one or more subterranean formations; and a body operable for assembly to the gripper after the gripper is assembled to the cable, wherein:

the gripper comprises:

a gripping insert operable to grip a substantially cylindrical surface area of the cable; and a chassis surrounding a cross-sectional circumference of the gripping insert;

the body comprises a plurality of rolling elements each rotatably coupled to the body; and after the body is assembled to the gripper:

the body surrounds and is rotatable around a cross-sectional circumference of the chassis;

the body and the plurality of rolling elements collectively rotate relative to the gripper and the cable in response to contact between a sidewall of the wellbore and at least one of the plurality of rolling elements as the cable is conveyed within the wellbore; and the plurality of rolling elements rotate relative to the body in response to contact with the sidewall of the wellbore as the cable is conveyed within the wellbore.

20. The kit of claim 19 wherein, at least after the gripper is assembled to the cable and the body is assembled to the gripper:

the plurality of rolling elements comprise:

a first rolling element disposed on a first side of the body;

a second rolling element disposed on the first side of the body and spaced apart from the first rolling element in a direction parallel to longitudinal axes of the gripping insert, the chassis, and the body;

a third rolling element disposed on a second side of the body that is opposite the first side of the body; and a fourth rolling element disposed on the second side of the body and spaced apart from the third rolling element in the direction;

the first, second, third, and fourth rolling elements have respective first, second, third, and fourth rotational axes;

the first and third rotational axes are substantially coincident;

the second and fourth rotational axes are substantially coincident;

the gripping insert comprises opposing shoulders between which the chassis is axially retained;

the chassis comprises an internal recess;

the gripping insert comprises a cylindrical upset received within the internal recess of the chassis;

the chassis comprises opposing chassis halves;

the gripping insert comprises opposing insert halves each received within a corresponding one of the chassis halves;

the body comprises opposing body halves; and each of the plurality of rolling elements is rotatably coupled to the body by a spindle and at least one bearing.

* * * * *